US006902149B2

(12) United States Patent
Piron

(10) Patent No.: US 6,902,149 B2
(45) Date of Patent: Jun. 7, 2005

(54) VULNERABLE TARGET PROTECTION SYSTEM

(75) Inventor: Ludwig A. Piron, Waterloo (CA)

(73) Assignee: Innofocus Consultants Limited, Waterloo (CA)

( * ) Notice: Subject to any disclaimer, the term of this patent is extended or adjusted under 35 U.S.C. 154(b) by 0 days.

(21) Appl. No.: 10/277,839

(22) Filed: Oct. 23, 2002

(65) Prior Publication Data

US 2003/0127636 A1 Jul. 10, 2003

Related U.S. Application Data

(60) Provisional application No. 60/409,272, filed on Sep. 10, 2002, and provisional application No. 60/330,512, filed on Oct. 23, 2001.

(51) Int. Cl.[7] ..... E04H 17/00; B64F 1/12

(52) U.S. Cl. ..... 256/1; 256/10; 256/23; 244/114 R; 52/652.01

(58) Field of Search ..... 256/1, 10, 23; 244/110 R, 110 C, 114 R, 110 F; 52/741.3, 651.11, 651.01, 750, 146

(56) References Cited

U.S. PATENT DOCUMENTS 6,604,732 B1 * 8/2003 Brinker ..... 256/1
2003/0115830 A1 * 6/2003 Jackson ..... 52/750
2004/0050014 A1 * 3/2004 LIsa et al. ..... 52/741.3

FOREIGN PATENT DOCUMENTS

| | | |
|---|---|---|
| DE | 736 723 | 6/1943 |
| DE | 742 133 | 11/1943 |
| DE | 29 85 765 | 2/1981 |
| FR | 2 696 537 | 4/1994 |

* cited by examiner

*Primary Examiner*—Daniel P. Stodola
*Assistant Examiner*—Victor MacArthur
(74) *Attorney, Agent, or Firm*—Dilip C. Andrade; Borden Ladner Gervais LLP

(57) ABSTRACT

A defense barrier for protecting a target from critical damage from the impact of a predetermined group of aircraft comprises: a plurality of towers spaced from the target, each tower being spaced from a neighboring tower by a distance less than the wingspan of an aircraft in the predetermined group of aircraft having the smallest wingspan in the group; each tower being spaced from the target at least a distance d given by the formula: d=h/tan(theta) where h is the height of the tower and theta is the smallest vertical approach angle of any aircraft from the predetermined group of aircraft sufficient to inflict critical damage to the target.

9 Claims, 12 Drawing Sheets

TOP VIEW

SIDE VIEW

TOP VIEW

SIDE VIEW

TOP VIEW

SIDE VIEW

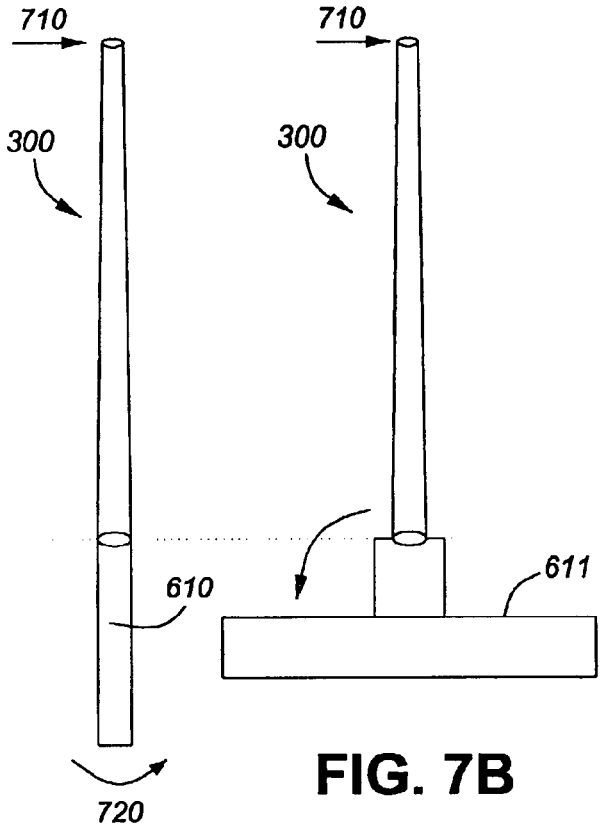
FIG. 7B
FIG. 7A
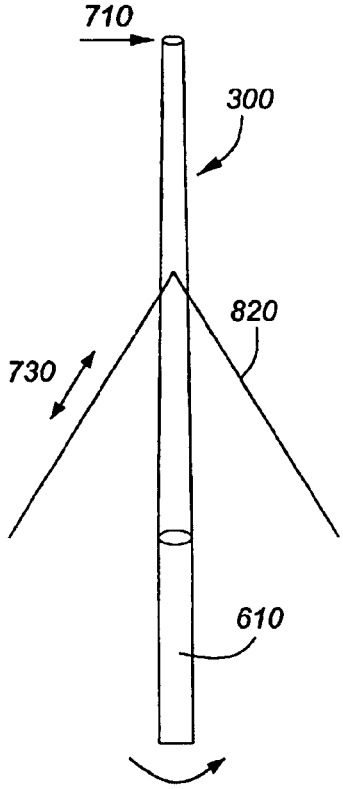
FIG. 7C

VULNERABLE TARGET PROTECTION SYSTEM

The present application claims the benefit of convention priority from U.S. Provisional Patent Application No. 60/330,512, filed on Oct. 23, 2001, and the U.S. Provisional Patent Application No. 60/409,272, filed on Sep. 10, 2002.

FIELD OF THE INVENTION

The present invention relates to a system of protection of vulnerable targets. In particular, the present invention relates to the protection of vulnerable targets against an attack by the impact of an aircraft.

BACKGROUND OF THE INVENTION

There is a high probability that the success of the terrorist strategy of 11 Sep. 2001 will again be repeated against one of the 108 nuclear power plants in North America. Such a scenario would require the capture of a large passenger aircraft by terrorists within a short time period in order not to trigger an air-to-air neutralization by military aircraft. This also means that other recently implemented security would have to fail.

Installations such as nuclear power plants are vulnerable to damaging attacks from large, high speed commercial aircraft. These plants were designed several decades ago to primarily withstand internal pressures and prevent the escape of radiated debris originating within the containment building. This protection is substantial and was adequate at its time, even against the commercial fleet of the day. To give an indication of protection, one nuclear power plant was given an adequate rating of protection against an aircraft crash into the containment building at 116,000 lbs. at 300 fps.

There are two levels of protection around the nuclear reactor—the containment building consisting of several feet of concrete and steel plating, and by several inches of high strength steel surrounding the nuclear reactor core. Similarly, protection around spent fuel is substantial and is being improved constantly. The protection of the reactor also provides protection for nuclear waste storage areas.

Today's aircraft have a combined speed and mass of 52 times the energy calculated in the 1980 study. If the protection of the containment building was only calculated as adequate in this referenced study, it appears abundantly evident that a force 52 times that calculated strength would easily penetrate the containment building. In addition, empirical evidence from the 911 Pentagon attack indicates that the initial penetration of a three foot wall continued through three other walls before the energy was dissipated. Using the higher speed/mass of a 747 and an optimal impact point, it is very probable that the energy of such a crash would split not only the containment building but the 8 inch steel casing of the nuclear reactor as well. Once breached, the ample jet fuel from the aircraft would combust the fuel bundles and the remaining radiated debris within the containment building.

SUMMARY OF THE INVENTION

The present invention a system for protecting vulnerable targets such as nuclear power plants, for example, by the use of a series of towers to deviate the trajectory of aircraft attempting to impact the target.

This invention intends to construct a passive defensive system that will guard the approach of aircraft to these vulnerable targets. The concept is to build sufficiently large and powerful towers that will: require the pilot to take a non-optimal approach to the target by avoiding the tower; or fly through the defense perimeter imparting damage to the aircraft resulting in dissipation of the impact energy and course deviation (both laterally and vertically).

It is important to realize that, at full speed and maximum weight, as required to cause critical damage, aircraft are difficult to control and will require superb piloting skills to hit a small target such as a nuclear reactor. For example, if the decision were made to fly over the towers and then descend rapidly into the target, the speed of the aircraft and the short distances would be such that the actual descent point would almost be on top of the target. If one considers that the target of interest, such as a reactor vessel, is a small target (typically 18 feet wide and 40 feet tall), compared to the sizeable reactor building in which it housed, then the mission is even more difficult. Additionally, there are limitations associated with the maneuverability of commercial aircraft such as the maximum descent angle. For example, the Airbus is control limited to a 10 degree glide path.

An equally important element for success is that the aircraft wing under heavy stress, such as at full weight and speed, is easily damaged from the leading edge.

Both the choice of a non-optimal approach or flying through the defense perimeter will result in minimizing damage to the power plant.

It should be made very clear that the present may not completely eliminate damage to the target. It will, however, significantly decrease the success of such an attack with the very high probability and provides a strong deterrent and may prevent the perpetrator from attempting such a high-risk strategy.

According to an aspect of the present invention, there is provided a defense barrier for protecting a target from critical damage from the impact of a predetermined group of aircraft comprising: a plurality of towers spaced from the target, each tower being spaced from a neighbouring tower by a distance less than the wingspan of an aircraft in the predetermined group of aircraft having the smallest wingspan in the group; each tower being spaced from the target at least a distance d given by the formula: d=h/tan(theta) where h is the height of the tower and theta is the smallest vertical approach angle of any aircraft from the predetermined group of aircraft sufficient to inflict critical damage to the target.

According to an aspect of the present invention, there is provided a defense barrier for protecting a target from critical damage from the impact of a predetermined group of aircraft comprising: a plurality of towers spaced from the target, each tower being spaced from a neighboring tower by a distance less than the wingspan of an aircraft in the predetermined group of aircraft having the smallest wingspan in the group; each tower being spaced from the target at least a distance d given by the formula:

$$d = \frac{h}{\tan\theta}$$

where h is the height of the tower and theta is the smallest vertical approach angle of any aircraft from the predetermined group of aircraft sufficient to inflict critical damage to the target.

An advantage of this system is that it is a passive system which will be continually on-guard against any air attack. The flexibility of this concept can be extended to different layouts of nuclear plants, and can provide protection against a current and contemplated range of commercial aircraft depending on the design parameters of the towers. This invention is also applicable to the protection of vulnerable targets including, but not limited to; nuclear power plants, (in particular, reactor vessels), nuclear and dangerous waste storage/containment facilities, research facilities (nuclear and biological weapons facilities), chemical plants, hydro electric dams, sensitive public buildings such as capital buildings and the Pentagon.

BRIEF DESCRIPTION OF THE DRAWINGS

The present invention is further described below, by way of example only, with reference to the drawings in which:

FIGS. 7*a* to 7*c* illustrate the effect of an impact force on a tower in accordance with the present invention;

DETAILED DESCRIPTION OF THE INVENTION

A fixed wing leading edge is very vulnerable to even slight impact at high speed, e.g. structural damage done by birds. Aircraft wings are not stressed to take full frontal impact but are well stressed for vertical movement as encountered in turbulence. The wing damage tolerance for a large passenger aircraft is such that it can withstand, at cruise speed, the impact of a 4 lb bird as defined by the Federal Aviation Regulations (FARs): FAR 25.571(e).

An important aspect of the present invention is to impart damage to the wings resulting in a modified aircraft trajectory such that the target would be missed with the majority of the impact energy, avoiding a breach in the containment building and the nuclear reactor. Furthermore, the wings are integral for fuel containment. Opening the wing would: divert combustible fuel away from the target; reduce the mass of the aircraft; and provide a source for the anticipated explosion.

The present invention is directed to using a defense barrier to prevent catastrophic or critical damage to a target. For example, in the protection of a nuclear site, the vital element is the reactor core within the reactor building. The destruction or damage by collision by an aircraft of the reactor building or nearby cooling towers, although undesirable, is far less serious than the breach of the reactor core. Similarly, at a dam site, the dam wall is the critical element and destruction of secondary buildings or structures can be considered non-critical if the dam itself remains intact.

Figure 1:
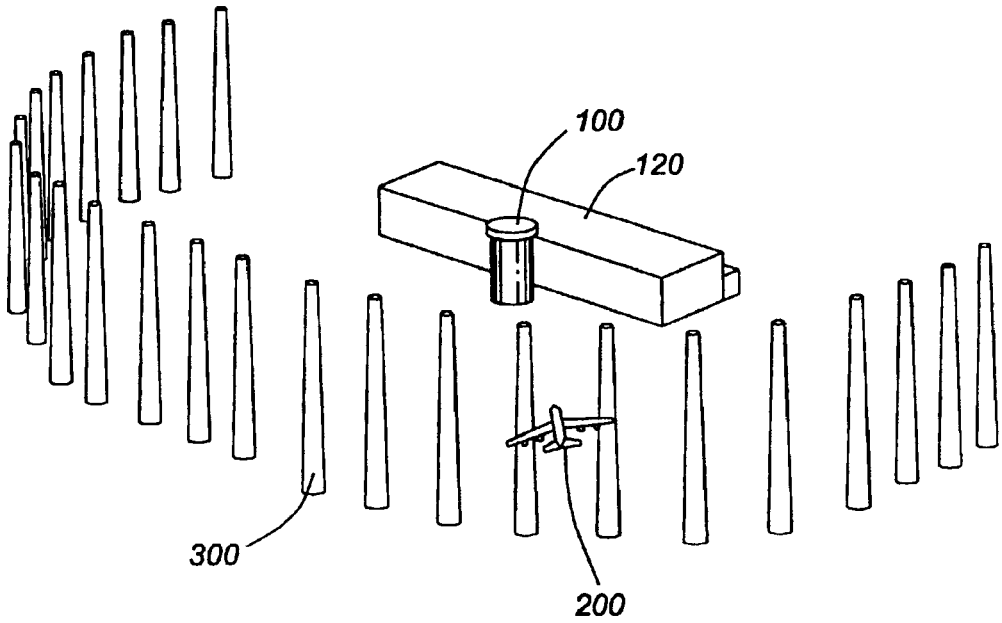
FIG. 1 illustrates the defense of a three reactor nuclear plant according to an embodiment of the present invention.

The main component of a defense barrier involves construction of a series of towers spaced appropriately around the target. This concept is illustrated in FIG. 1, showing a perimeter of towers 300 surrounding one side of a reactor building 100 of a nuclear power plant for protection against an aircraft 200. The other side of the reactor building is protected by other buildings such as cooling towers 120. Although the towers 300 are illustrated as being inline and approximately equidistant from the reactor building 100, they need not be as long as they afford the protection detailed below. For example, they could be different distances from the target or staggered or separated by non-uniform distances. They could also be of different heights as long as each tower is at least a required height (a function of distance from the target as discussed below). In one embodiment, given an airplane glide path of 20 degrees, a tower having a distance from the target of about 1000 ft could have a height greater than a resulting minimum required height of about 360 feet.

Figure 2A:
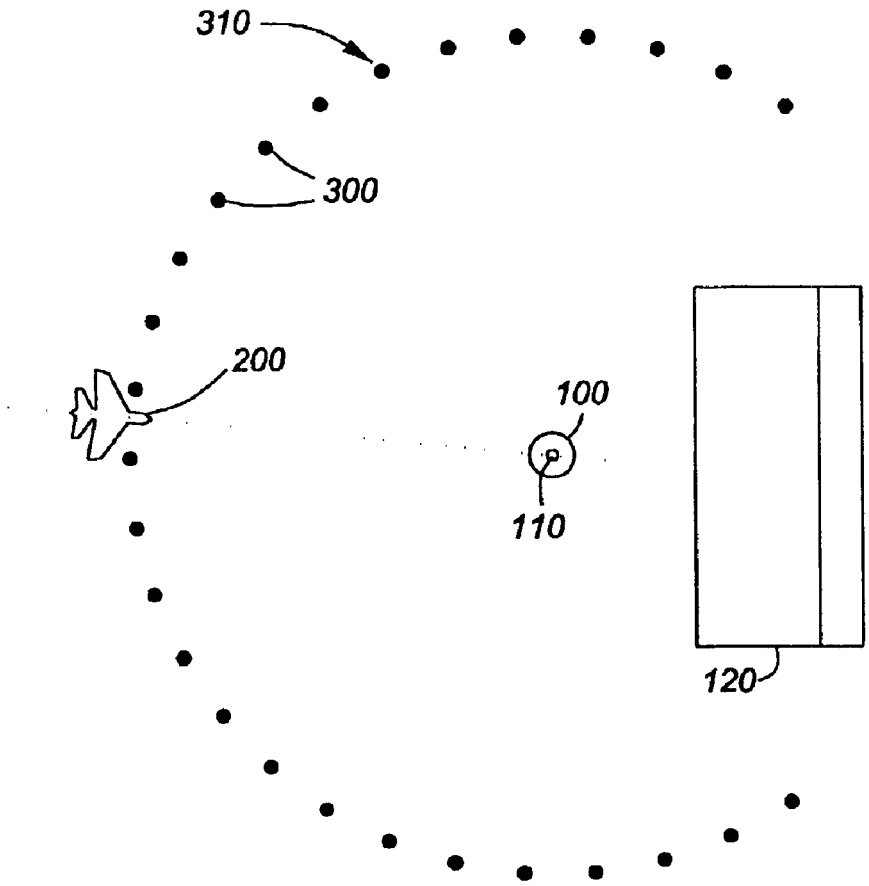
FIGS. 2*a* and 2*b* illustrate tower placement around a nuclear reactor and reactor vessel in accordance with the present invention.
Figure 2B:
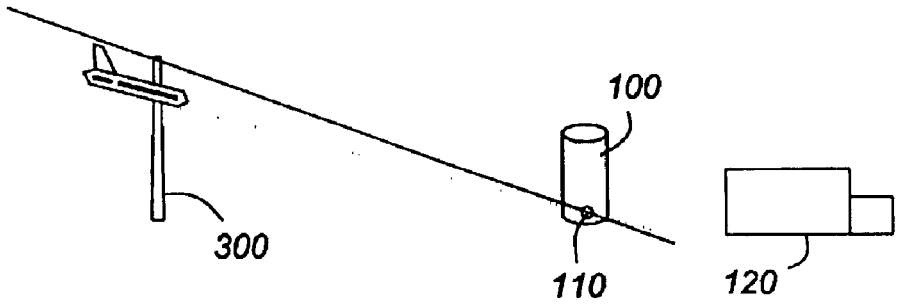

Referring to FIGS. 2*a* and 2*b*, the towers are positioned in such a way so as to ensure the pilot is unable to avoid contact with the towers by way of a severe glide path or maneuvering between the towers without taking significant damage. The towers 300 forming a tower perimeter 310 are spaced from the target reactor building 100 so that the amount of deviation from the initial trajectory is enough to ensure the target is in fact missed. The critical portion of the reactor building 100 is the reactor vessel 110 in the building.

The towers 300 of the present invention are strong enough to impart enough resistance to the wing to ensure local failure of the wing at the point of impact or failure by shear forces along the length of the wing, i.e. failure distant to the point of impact.

It is known that current reactor vessel protection is adequate for small, highly maneuverable aircraft; however, as commercial aircraft have become faster and more massive, the reactor protection has not scaled appropriately, leaving these critical structures vulnerable to attack. Therefore, one must analyze the vulnerability of these structures with respect to these larger aircraft and determine which combinations of aircraft sizes and speeds can lead to critical impact conditions.

The first step in this method is to identify critical structures at a given nuclear power plant (i.e. reactor vessel and spent fuel containment structures) and determine the current defensive structure's ability to withstand an attack.

The strength of any current defense structures from all possible approach paths based on detailed plans of the facility are determined by: evaluating natural defenses such as adjacent hills and forests; and evaluating non-critical structures, defined herein as primary defense structures and their ability to block aircraft approach (e.g. water cooling towers, administrative buildings, generator/turbine buildings).

Since there are only approximately five different nuclear plant layouts, this analysis only needs to be done for a small number of plants and these results can be generalized to other plants similarly constructed. However, there are minor differences such as the number and location of stringers within the containment building that need to be evaluated individually.

Next, an analysis is conducted to determine, for each of the largest aircraft to the smallest aircraft (considering number of currently active and anticipated aircraft), the potential energy impact of the aircraft, assuming the highest possible speed for a particular approach path. The maximum speed for a particular approach is a function of the facility layout, particularly the critical target's exposure. If the energy of impact attained by an aircraft/approach combination exceeds the strength of the nuclear defense structures, then that approach must be guarded using a defense barrier comprising a series of defense towers.

The tower defense acts to defend the structure in a passive way and takes advantage of the operational limitations of a large aircraft. Passively, the towers provide an obstacle which an attacking pilot is required to avoid. The pilot can attempt to fly precisely between the towers. Positioning the towers at a spacing such that an aircraft in level flight can not fly between the towers (i.e. on the order of the aircraft wingspan) means that the only option is to attempt a steep bank between the towers (highly unlikely given the maneuverability of large aircraft at these necessary speeds). The pilot can choose to approach at a steep angle of descent such that the top of the towers would be narrowly missed en-route to the small target (i.e. bottom 20 feet of the containment building). In order to accomplish this, the pilot must reduce aircraft speed to permit the rapid rate of descent and to ensure continued control of the aircraft. A 747 for example would be limited to a speed of 500 fps and a descent angle of 20 degrees. At this speed and angle of strike it is unlikely that the critical penetration of the nuclear reactor can be achieved.

Figure 3A:
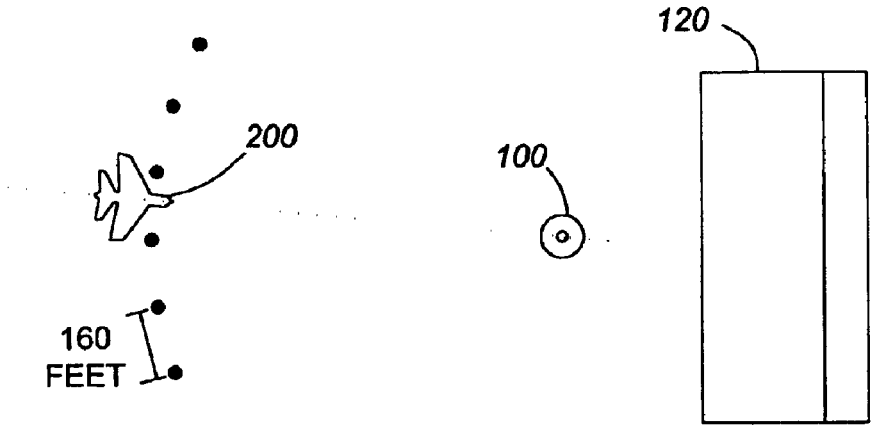
FIGS. 3*a* and 3*b* illustrate example tower spacing, tower height and distance from tower to target to protect the installation against an aircraft of at least the scale of a Boeing 767-ER.
Figure 3B:
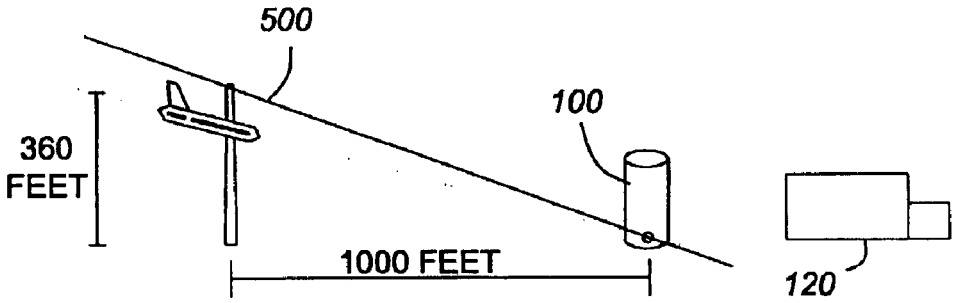

More specifically, a tower 300 of given height H, at a given distance D from the target would limit the glide path (approach angle) of arctan(H/D) as indicated in FIGS. 3*a* and 3*b* (H=360, D=1000). Given this approach angle, shown in the Figures as 500 a particular aircraft is limited to a maximum approach speed, and is provided a smaller target prospective and is at a non-optimal impact trajectory (i.e. component of impact vector would be non-normal to the containment wall).

As an active defense, (i.e. pilot chooses to fly full speed into the barrier), the towers act as an obstacle which imparts damage to the aircraft resulting in a large deviation from the initial trajectory as well as acting to dissipate the energy of the aircraft impact over a larger area. It is known that the most vulnerable part of an aircraft is the leading edge of its wing. By taking advantage of this weakness, one can consider imparting critical damage to a section of the aircraft wing with minimal impact energy resulting in a deviation of the trajectory of the aircraft from the target, and/or dissipation of the energy of the impact by breaking the aircraft up into many sections.

Again, modification of the design parameters of the towers can provide greater or lesser protection depending on the vulnerability of the target. The strength of the towers determines the failure mode at the impact point of the wing. The larger the force the tower can withstand during the impact, the larger the force acting on the wing of the aircraft. There are two failure modes of the wing. The first is local failure due to breach of the first structural spar by the tower. This results in the wing separating from the rest of the aircraft beyond this point. The second failure mode is shear failure at a point near to the fuselage, distant from the point of impact. Shear failure is expected to occur with high impact forces applied at a position near the wing tip (i.e. large bending moment on wing) and results in a larger amount of the wing being separated from the aircraft. Therefore, from the perspective of tower design, the amount of wing that is separated from the aircraft is determined by the force of the impact (dictated by the composition and strength of the tower), and the position at which this force is acting (dictated by the separation of the towers).

The interaction of the tower and the wing results in a force being imparted on the aircraft, a shift in momentum due to the collision, moment due to force acting at a distance from the center of gravity, potential explosion due to sparking and exposure of jet fuel and separation of a wing from the aircraft. The force imparted on the aircraft is expected to act over a short interval of time and therefore not deviate the aircraft substantially due to a yaw effect. However, the separation of the wing from the aircraft results in an immediate large differential in lift due to the loss of lifting surface. This lift differential results in an instantaneous roll towards the damaged side and the direction of yaw caused by the impact. The loss of engines on one side accelerates the rolling moment.

A strong downward pitch also results. The first factor is the pitch differential due to imbalance between the tail section and the remaining wing resulting in a nose down attitude. The loss of thrust in one or more engines also reduces lift. More importantly, the buff mass has severe drag further increasing the downward pitch.

After the impact, the aircraft continues along its modified flight path acted on by aforementioned unbalanced forces and moments, resulting in the aircraft continuing on a divergent flight path. In a simplified static analysis, one can assume these thrust, lift, drag, rolling and yawing characteristics to be constant whereas in reality these functions will be changing continuously depending upon the attitude of the body. In point of fact, the aircraft prior to the collision is largely a streamlined aerodynamic body. Aft of the collision, having lost one wing and in an out of control rolling spinning motion, its remains are nothing but a highly bluff body with ever increasing drag penalties. The further the point of impact is from the target, the greater time these forces have to act on various pieces of the aircraft resulting in a larger deviation relative to the desired target. Therefore, the further the tower is located from the target the more deviation of the aircraft is expected. This increased distance also provides a greater area to dissipate the energy of any post-impact (tower/wing) explosion as well as a greater distance over which the tumbling body de-accelerates due to a combination of increasing drag and decreased thrust. The tumbling of the aircraft pieces leads to an impact scenario with the containment building where the energy is be distributed across a larger area than if the aircraft impacts the containment building in a streamlined aerodynamic missile orientation if the trajectory were to be uninterrupted. The random orientation of the aircraft and its wing sections based on six degrees of freedom aerodynamic analysis (post tower impact) can be evaluated in an analogous manner to the previous probabilistic analysis performed on impact loading conditions of high speed missiles on nuclear containment structures.

The resultant impact energy is reduced significantly by:

imparting momentum to the tower at impact;

separation of aircraft into many pieces, reducing mass of body impacting target. For example, a 747 losing both of its wings and associated loads will lose approximately 65% of its original mass. This mass is now approximately the mass of the aircraft studied in the 1980's. The study proved that the containment building was able to withstand the impact of this mass;

separation of fuel from aircraft through wing breaching, leading to fuel spillage as well as probable ignition of fuel for explosion;

reduction of velocity of aircraft pieces due to loss of thrust, aerodynamic drag;

redirection of aircraft pieces from target, potentially no-impact condition with target (i.e. pieces impacting ground);

modification of impact vector from normal or near-normal to containment structure to oblique orientation; and modification of aircraft orientation from a missile-like focused impact to distributed impact.

The goal of the defense barrier of the present invention is to shift the probability of a successful breach of the reactor vessel through strategic placement of a series of towers designed to impart severe damage to an aircraft wing structure. A particular tower design and layout for a particular plant can be evaluated using current standard analytical techniques in concert with empirical testing knowledge of containment structures, wing structures and reactor vessels.

Analysis of the impact conditions of the aircraft wing and tower, as well as the aircraft and nuclear facility can be performed using dynamic computer models, i.e. LS-DYNA3D, an explicit, nonlinear finite element analysis (FEA) program. Analysis of the flight path after impact with the tower, impact with the ground or nuclear facility can be investigated using a six degrees of freedom computational fluid dynamics (CFD) trajectory analysis. This analysis can be repeated for a series of aircraft, (those believed to impart critical damage to the facility without intervention), for a various trajectories centered on the target (various speeds, glide slope, engine thrust conditions and impact position relative to towers, i.e. height of impact on tower, tower impact position on wing). The probability distribution of the final energy of impact at the reactor vessel is the final metric by which the effectiveness of the design is evaluated. This metric is a function of the tower design and relates to the cost of the project. Larger, stronger and more tightly spaced poles are a more intensive construction effort but result in a lower probability of reactor vessel penetration.

The design requirements for the towers previously indicated present a unique design challenge. Building a tower solely for the purpose of inflicting damage to the wing of a large commercial aircraft is governed by very different requirements than current tower designs; however the force requirements on such a structure are still within the realm of current engineering and construction practice.

If one considers a defense strategy against an aircraft on the scale of the Boeing 767-ER and larger, one can derive a responsible approximation for a tower defense strategy (tower dimensions, tower spacing). Using the information available on the geometry of the aircraft (wingspan 170.3 ft), the towers are to be spaced such that a minimum amount of the wing of the smallest aircraft, or critically sized aircraft, contacts the tower. On a first approximation appropriate tower spacing is 160 feet center to center as indicated in the top and side views of FIGS. 3*a* and 3*b*. Considering a 747-400, (wingspan 211.4 ft) an even larger proportion of the wing will come into contact with the towers, resulting in a larger deviation of the intended trajectory given that there is a greater area of the wing destroyed. Given a tower spacing and a wing span, various impact scenarios can be expected based on assumed strike locations along the wing or fuselage:

(1) Aircraft striking two towers with fuselage midway between towers: (no engine lost for 747 scenario, tower spacing 160 ft);

(2) Aircraft striking one tower with a near miss on a second tower (one engine lost, for 747 scenario, tower spacing 160 ft);

(3) Aircraft striking one tower midway between fuselage centerline and location per sub-para 2 (two engines lost, for 747 scenario, tower spacing 160 ft);

(4) Aircraft striking one tower with fuselage. It is assumed in this case that the shape of the fuselage together with the deflection of the aircraft and tower will lead to the main strike to be at the wing root. (two engines lost, for 747 scenario, tower spacing 160 ft);

The height of the tower is dictated by the maximum glide path allowed by the pilot and the amount of space one wishes to put between the target and the point of impact between the wing and the tower as indicated in FIGS. 2*a* and 2*b*. Initial estimates indicate that at maximum cruise speed, that greatest possible glide angle would be much less than 20 degrees. The further the towers are spaced from the target, the more meaningful the re-direction of the mass of the aircraft in the relatively short distance between tower and facility. In FIGS. 3*a* and 3*b* this is indicated as 1000 feet, however, the actual value scales according to the amount of deviation expected according to the impact scenario and the size of the target to be protected.

Figure 4A:
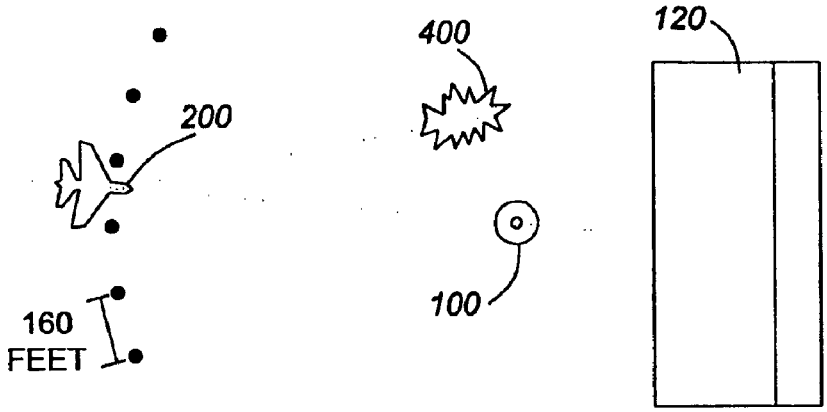
FIGS. 4*a* and 4*b* illustrate the effect of an aircraft's impact into a tower.
Figure 4B:
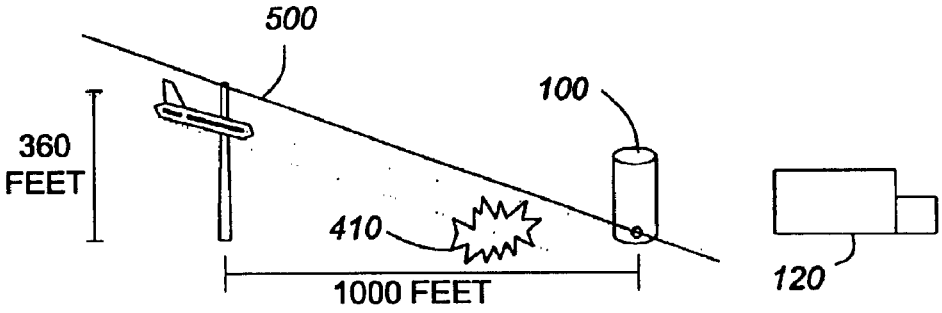

The amount of deviation in the aircraft trajectory is a function of the impact scenario, i.e. yaw, roll and pitch variation due to: lift differential due to loss of lifting surface; roll and pitch differential due to imbalance in lifting surfaces; explosive force of fuel; shift of momentum due to the collision; aerodynamic drag penalties; and differential thrust due to lost engines, etc). This deviation is illustrated in side and top views of FIGS. 4*a* and 4*b*, showing the aircraft and its intended trajectory, the deviation that might occur due to impact and the resulting impact point with the ground. For example, over a space of 1000 ft, a variation in the trajectory of the aircraft of less than 1 degree due to a combination of all forces ensures that a 30 foot target (typical of a reactor vessel) would be missed. These values scale according to the target and impact conditions. In FIG. 4*a*, the yaw and roll effect 400 is shown. In FIG. 4*b*, the loss of lift effect 410 is shown.

Given this analysis, an appropriate arrangement of towers is a spacing of towers 160 ft, center to center, at a distance of 1000 ft from the target, at a height of 360 ft, in order to protect against aircraft such as a Boeing 767-ER and larger. However these values can be modified depending on the target, the environment around the target and the level of security desired.

Spacing the towers more closely protects against potential infiltration by smaller aircraft and ensures more impact points or impact at positions closer to the root of the aircraft (disabling a larger section of the wing). Spacing the towers farther out from the target ensures a more meaningful deviation of the trajectory of aircraft; however this requires taller towers to preclude avoidance of the towers through a steep descent and further requires erecting a greater number of towers to cover the same area.

The towers must be designed to provide enough resistive force to damage the wing. Initial calculations based on bird-strike criteria, assuming that 2 times the maximum energy of a 4 lb bird striking a wing at the maximum ground level cruising speed of a Boeing 747-ER (0.85M=647 mph=949 ft/s), indicate that an impact energy of 1.8 E+06 ft.lb/s$^2$ would cause local destruction of the wing. Conversion of this to a force equivalent over the length of leading wing edge to the first structure spar indicates that 1.2 E+06 lbs of force ensures local destruction wing. Further analysis indicates that shear, or bending failure of the wing due to this impact at positions 960 inches and 642 inches from wing root occurs at higher applied forces between 2.7 E+06 lbs and 1.2 E+07 lbs respectively. In shear failure there may or may not be local failure at the point of impact. These calculations are presented are provided to indicate the magnitude of forces that the towers need to provide to ensure a large section of the wing is removed. These numbers apply to a Boeing 747-400 aircraft and this analysis can be easily applied to other aircraft.

Figure 5A:
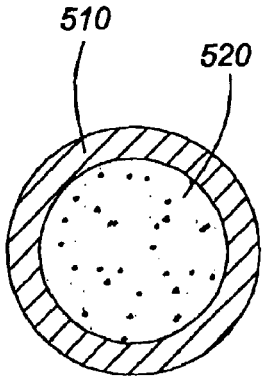
FIGS. 5*a* to 5*f* illustrate alternative tower cross sections in accordance with the present invention.
Figure 5B:
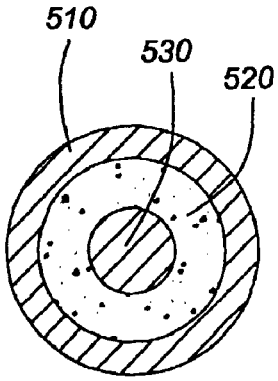
Figure 5C:
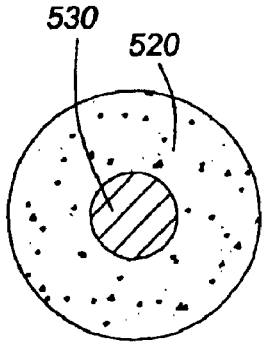
Figure 5D:
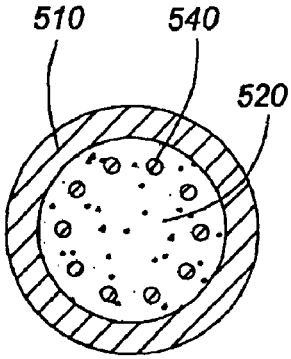
Figure 5E:
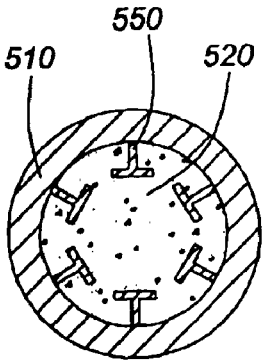
Figure 5F:
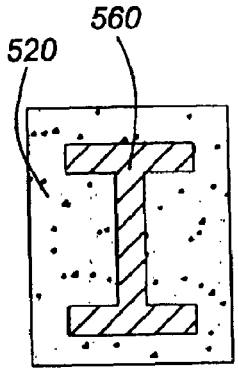

Towers of the magnitude presented (heights on the order of several hundred feet) and with maximum strength requirements on the order of 5.0 10E+6 lbs (associated with bending/shear failure of the wing near the root) can be built with traditional construction methods. Of these methods, composite concrete and steel tower structures are well suited to provide economical material utilization and construction, as well as high strength. These composite structures include concrete 520 encased steel 510 columns shown in FIG. 5*c* and steel outer tubular design filled with concrete 520 as depicted in the cross sectional view of FIG. 5*a*. This design offers the advantage of requiring no form work during construction, thus reducing construction costs, as well as demonstrating to be a very strong design for axial, transverse and cyclical loading conditions. Variations include using a central steel column 530 or hollow tube (FIG. 5*b*), rebar 540 in the concrete 520 (FIG. 5*d*), metal stiffeners 550 in the concrete 520 (FIG. 5*e*) and concrete 520 encased I-beam 560 (FIG. 5*f*).

Figure 6A:
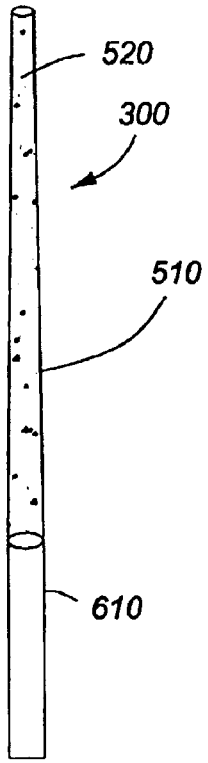
FIGS. 6*a* to 6*e* illustrate aspects of tower design according to the present invention.
Figure 6B:
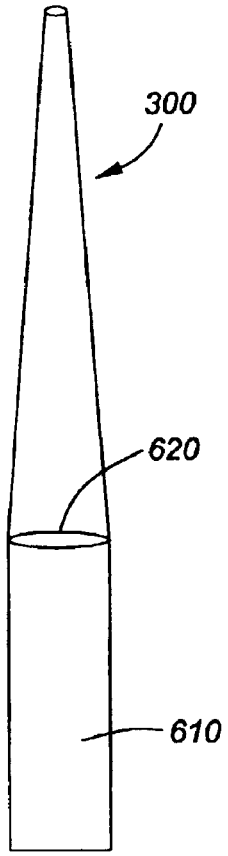
Figure 6C:
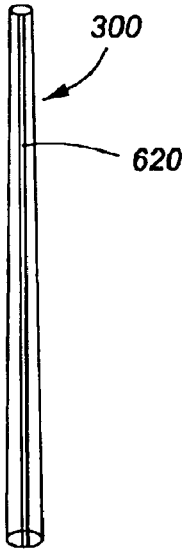

The use of stiffened concrete-filled tubular (CFT) columns as the fundamental load bearing components in many structures (i.e. buildings, piers, bridges) is currently standard practice. It is well known that the behavior of these CFT columns is heavily influenced by the width-to-thickness ratio (D/t, D for diameter of a circular cross section, t for thickness of the steel tube wall), height-to-width ratio (L/D. L for height of the tower), the cross sectional shape 620 of the steel tube (circular, elongated or rectangular), and the strength ratio of the concrete and the steel. Shown in FIG. 6*a* is a tapered tubular tower design having base 610 where the dimensions of the tower (ratio of height to base diameter, diameter of base, diameter of top, depth of base positioned underground) and the composition of the steel and concrete can be calculated to provide the required strength using traditional methods. For example, FIG. 6*a* illustrates a concrete 520 filled stainless steel outer wall 510 with a ratio of steel to concrete ranging from 40:1 to 120:1. The base 610 of the tower 300 should be on the order of one third of the height. Referring to FIG. 6*b*, to resist a greater force applied at the top of the tower 300, a larger diameter tower 300 for a given height is required, given a fixed ratio of steel to concrete across the tower cross section. A larger base 610 or foundation will resist a larger moment due to the applied load at the top of the tower.

For example a tower with the following design parameters is believed to provide resistance to a force applied to the top of the tower, on the order of the forces believed to fail the wing of a Boeing 747.

L, tower height: 360 feet, approximately 110 meters.

Based on assumption of maximal glide path of 20 degrees, and 1000 foot separation of towers to target.

$F_{critical}$: Maximum bending force applied assumed to be 5.0 10E+6 lbs $D_b$, Tower base diameter: 24 feet, approximately 7.3 meters.

Based on a height to base diameter ratio of 15:1.

$D_t$, Tower top diameter: 13.12 feet (4 meters).

Based on standard tapering of tall columns.

Steel tube thickness at base: 6.8 inch

Based on current standard concrete filled tube designs.

Outer steel tubing: SS-150-050(2), cold formed carbon steel, with yield strength of approximately 342 MPa. Based on standard engineering practice.

Concrete Innerfill: Standard High Strength Concrete: 40 MPa

Based on standard engineering practice.

The composition of the steel, and concrete can further be determined to provide maximal strength using traditional methods (i.e. re-bar reinforced concrete, cold-formed or annealed steel tubing). The construction of the tower may be such that it is built in multiple sections to facilitate construction. Additional design modifications to improve the strength include welded ribbing, or beams along the length of the tower. Referring to FIGS. 7*a* to 7*c* the foundation of the towers can also be built in such a way so as to resist a large force applied at the top end of the tower (worst case loading scenario). Again a variety of standard engineering practices can be employed as needed. FIG. 7*a* shows an impact 710 applied to tower 300 and a corresponding resistive movement 720 in the foundation. FIG. 7*b* shows a different foundation 611 resisting a force impact 710. FIG. 7*c* shows the use cables 820 or guy wires to resist an impact due to tension 730 in the cables 820.

Figure 6D:
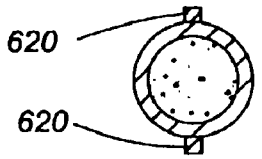
Figure 6E:
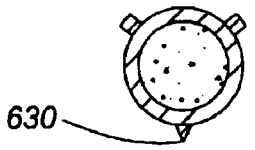

Opening of the wing using a protruding structure such as a sharp edge 630 in FIG. 6E or a reinforcing beam 620 shown in FIG. 6*d* on the front edge of the tower 300 can also be used in conjunction with this design (FIG. 6*d*). Further additions may include a fuel ignition mechanism positioned either within the tower 300 or on the surface of the tower such as an electrical wire and special paints to enhance sparking.

Figure 8A:
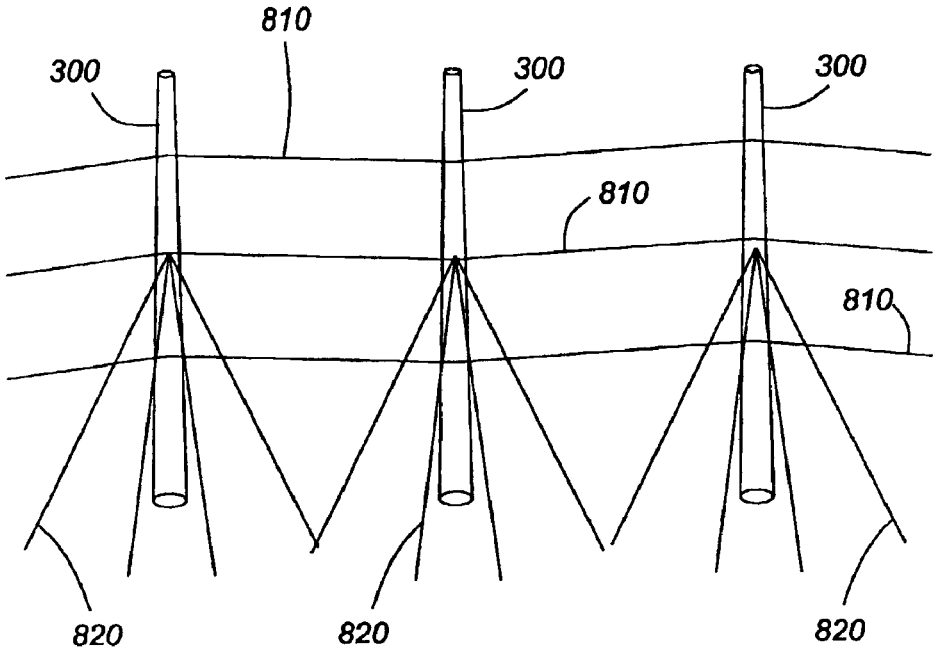
FIGS. 8*a* and 8*b* illustrate the use of cables to support the towers.
Figure 8B:
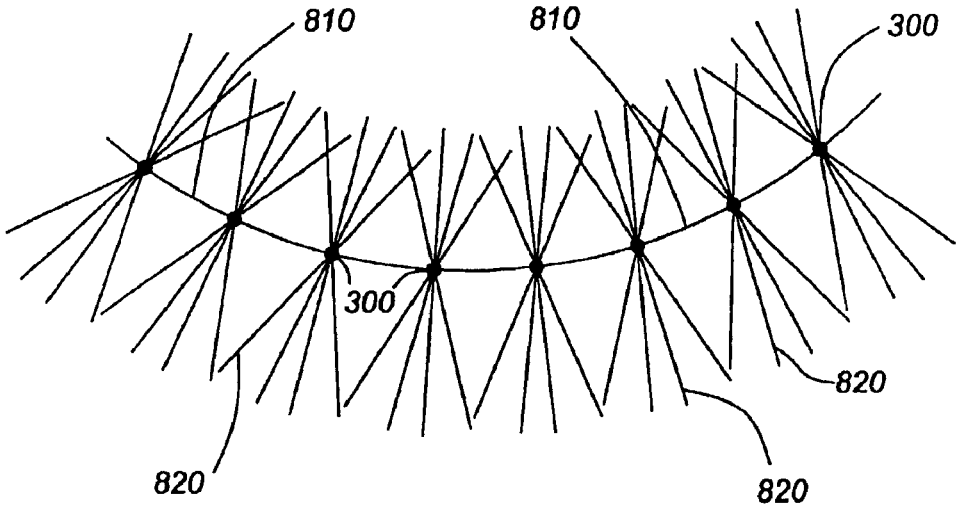

In order to improve the strength of the individual towers, they can also be tied into one another to share the loading as a system. These towers can be linked together using cables 810, rigid linkages, or linkages with limited degrees-of-freedom to accommodate some motion of the towers individually. In this arrangement, the deformation of one tower stresses the linkages to the other towers and effectively transfers some of the loading as indicated in FIGS. 8*a* and 8*b*. This principle can be applied to various arrangements of the towers (staggered, or in-line) with towers of various compositions and sizes. Connections between towers need not be limited to adjacent towers. Cable linkages can also be extended to link the tower at various points to the ground in the same manner so that many towers are supported with standard construction practices (FIGS. 8*a* and 8*b*). Linking the front edge of the tower in tension to a ground support by way of a guy wire 820 can help transfer some of the loading from the main support column of the tower.

These towers can also serve other secondary purposes such as communication tower functions or provide towers for wind power generation. The use of these towers for multiple uses improves the economic feasibility of the project as long as they do not interfere with the primary function of the towers to impart damage on an aircraft and greatly reduce the probability that it will impact the intended target.

Figure 9:
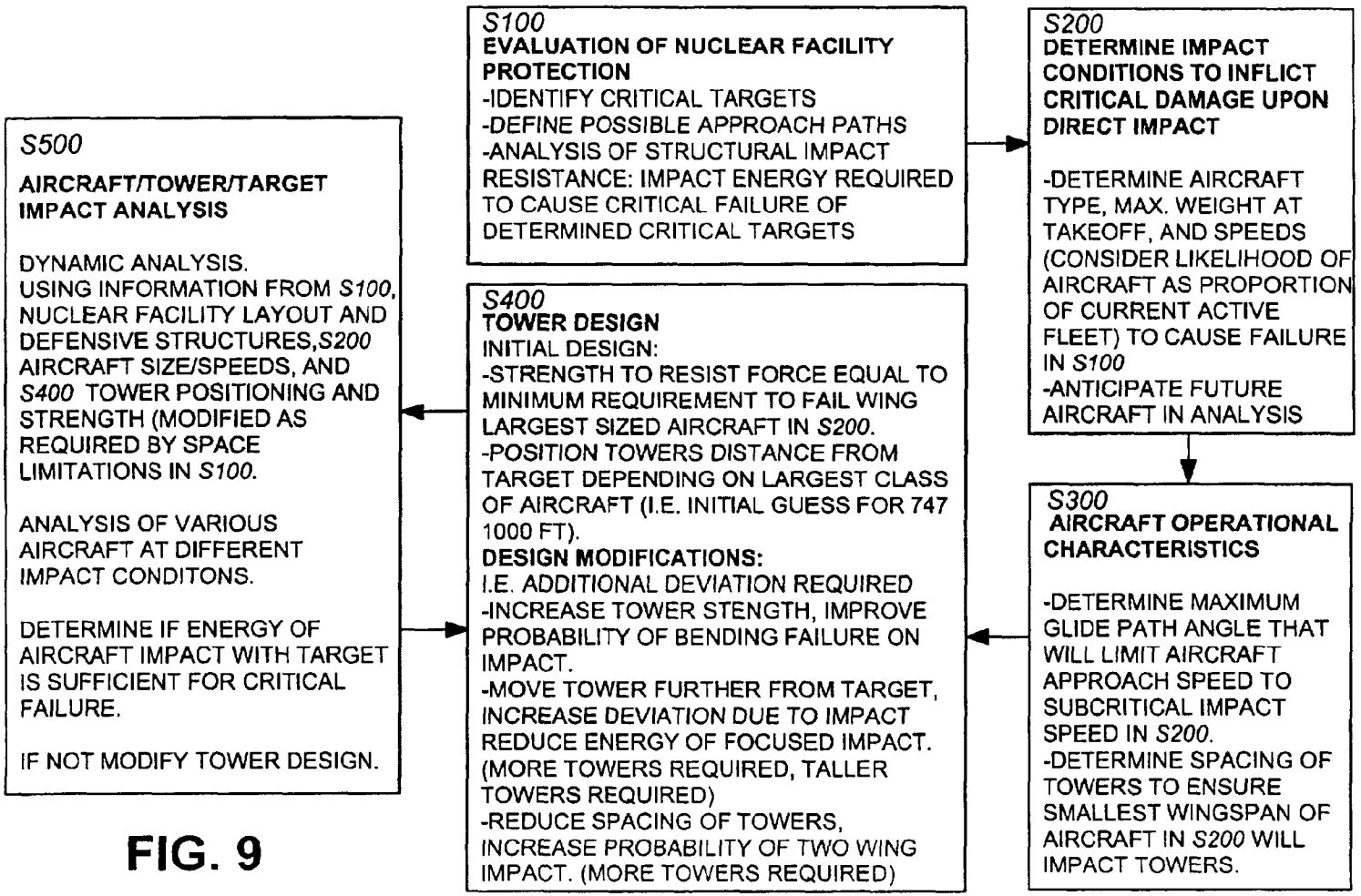
FIG. 9 is a flow chart providing a method of designing a defense barrier for protecting a vulnerable target in accordance with another aspect of the present invention.

Referring to FIG. 9, a method of the present invention comprises:

Evaluating target protection (step s100);

Determining impact conditions to inflict critical damage upon direct impact (step s200);

Determine aircraft operational characteristics (step s300);

Iteratively:

Design defense towers (step s400); and

Conduct aircraft/tower/target impact analysis (step s500)

Until tower defense is adequate.

Figure 10:
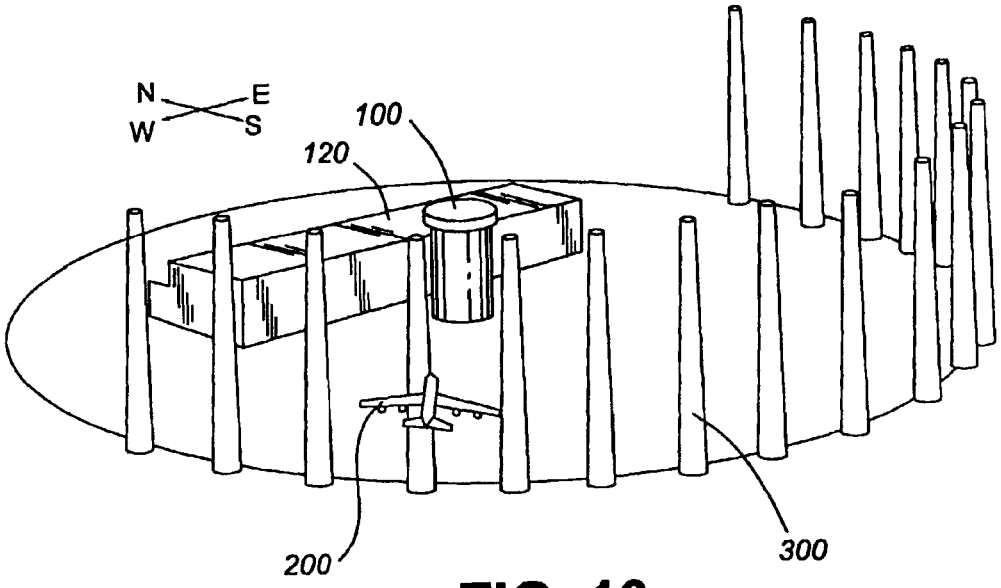
FIG. 10 illustrates an example defense barrier in accordance with the present invention protecting a nuclear power plant.
Figure 11:
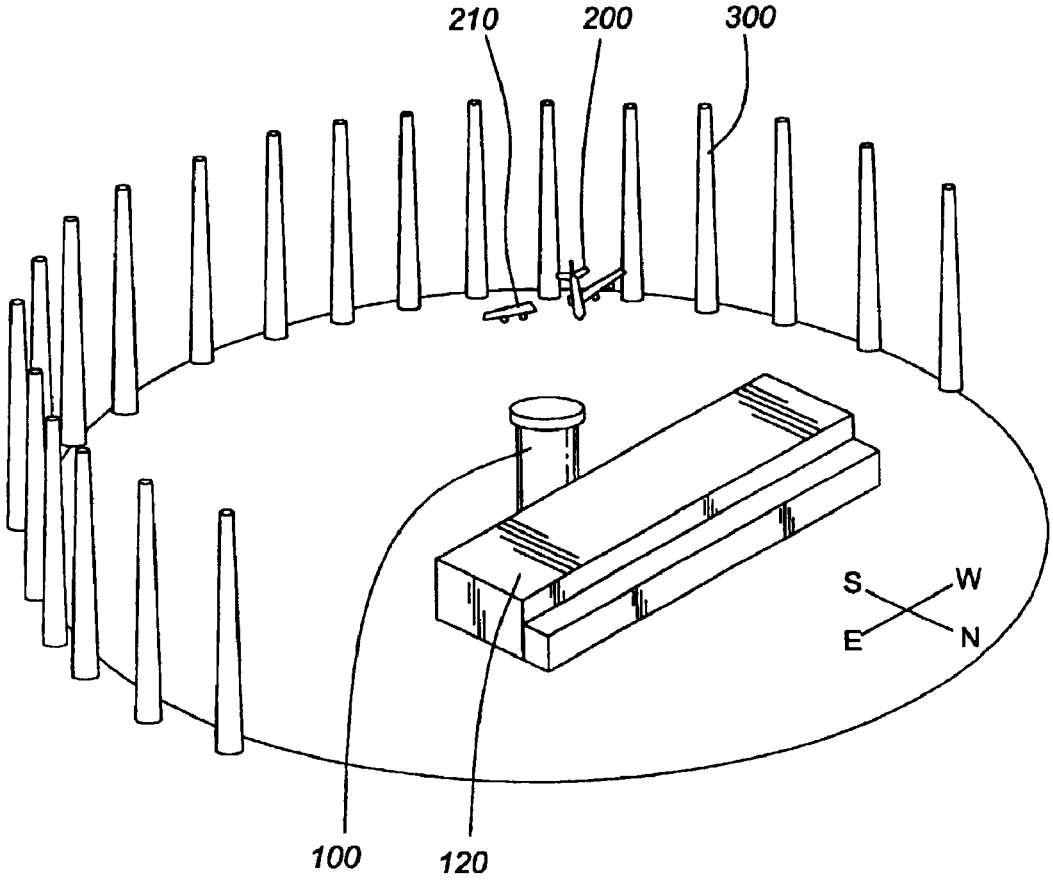
FIG. 11 illustrates the loss of one wing after an aircraft impacts the defense barrier of FIG. 10.
Figure 12:
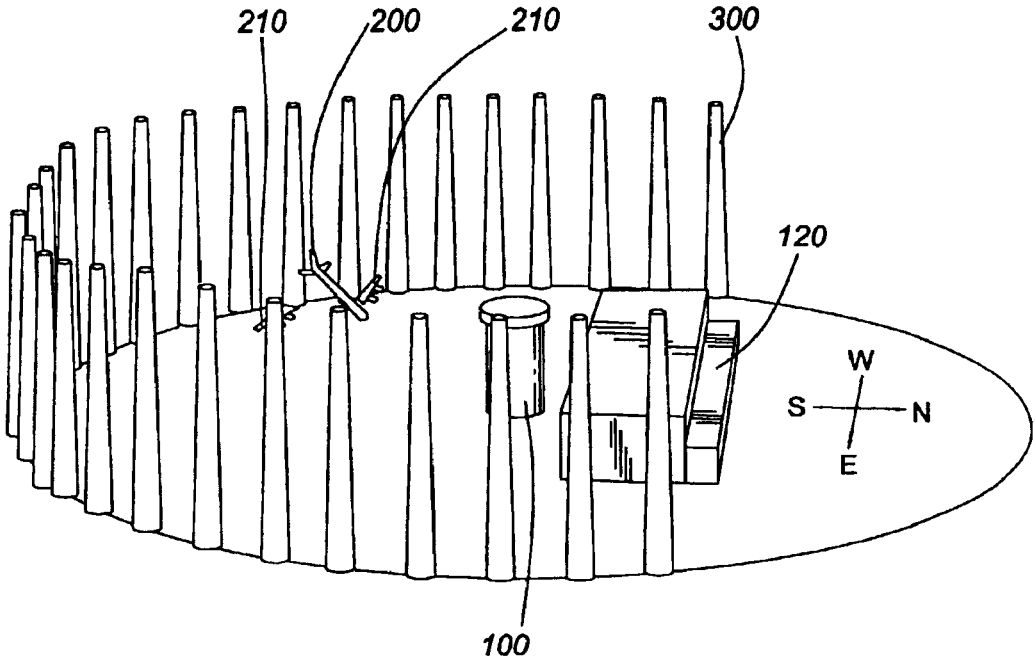
FIG. 12 illustrates the loss of two wings after an aircraft impacts the defense barrier of FIG. 10.

Referring to FIGS. 10 to 12, the following example illustrates the method of FIG. 9 applied to a tower defense strategy for a nuclear plant. This example illustrates how the requirements of the nuclear plant determine the tower design and the method required to achieve that design.

Step s100 Target Definition: Consider a highly vulnerable North American plant, single reactor vessel as the only critical target, capable of a maximum impact of by a 300,000 lb aircraft at 340 mph (500 ft/s). This force is expected to breach the reactor vessel with a direct impact. This can be accomplished with a set of defined approach paths. Referring to FIG. 10, there is illustrated a series of towers 300 protecting a reactor building 100 from an aircraft 200. A bank of generators and cooling towers 120 is behind (North of) the reactor building 100 and protects that approach. In this example, considering the layout of the power plant, only a front approach needs to be protected.

Step s200: Critical Aircraft Definition: The critical impact energy limits the impact to that of an aircraft larger than a fully fueled B767-ER. The current aircraft fleets include the following aircraft: B767, B777, A340 and B747-ER. These aircraft (and structurally and functionally similar aircraft) define approximately 90% of the current active fleet in North America. The specifications for these aircraft are listed below, including the maximum speed at impact considering control restrictions.

| Aircraft | Wingspan (ft) | MTOW (lb) Max takeoff weight | Max speed (ft/s), At impact conditions |
|---|---|---|---|
| B767-400ER | 170.3 | 450,000 | 700 |
| A340-300 | 197.1 | 606,300 | 720 |
| A330-300 | 197.8 | 513,700 | 720 |
| B777-200ER | 199.9 | 656,000 | 720 |
| A340-500 | 208.2 | 807,400 | 720 |
| B747-400 | 211.4 | 875,000 | 720 |
| B777-300ER | 212.6 | 750,000 | 720 |

One determines the protection criteria for the plant to be such that if one of the aircraft above is selected to fly into the plant at any of the glide paths from determined from the layout of the nuclear plant then the probability of the aircraft impact causing critical failure is reduced to less than 95% (very low probability of success).

Step s300: Aircraft Control Characteristics. From the aircraft defined above, the maximum possible glide path of the most maneuverable and smallest aircraft (B767) is 20 degrees. Making an initial assumption that the towers will be positioned at a distance from the target of 1000 feet, this defines a tower height of 360 ft. Considering the wingspan of all the aircraft, the spacing between towers is chosen to ensure that the narrowest aircraft will collide with the towers in all impact scenarios (i.e. the plane can not fly between the towers) and that a reasonable portion (10 feet) of at least one wing is contacted. This results in placing the towers at a spacing of 160 feet. Given this spacing and the design requirement that the towers must protect a total angular extent of the southern side of the nuclear facility (200 degrees), the total number of towers required is 22. This configuration is shown in FIG. 10. Considering the layout of the nuclear plant, there is no conflict in building the towers at these positions.

Step s400: Tower Design. As a first assumption the towers are designed so as to shear off the wings of the largest considered aircraft. In this case one requires a maximum force applied at the top of the tower of 5.10e6 lbs. This value was determined by analysis of the structural members of the wing box of a B747.

Considering the bending moment of the maximum loading applied at a height of 360 feet from the base, the tower must be massive and strong enough to withstand the bending moment at all cross sections along its height. Further the tower must be massive enough to present a substantial mass to the wing section.

Initial design of the tower is based on a concrete filled tube, tapered along its length as described earlier in this document:

L, tower height: 360 feet, approximately 110 meters.

$F_{critical}$: Maximum bending force applied assumed to be 5.0 10E+6 lbs $D_b$, Tower base diameter: 24 feet, approximately 7.3 meters.

$D_t$, Tower top diameter: 13.12 feet (4 meters).

Steel tube thickness at base: 6.8 inch

Outer steel tubing: SS-150-050(2), Yield strength: 342 MPa.

Concrete Inner fill: Standard High Strength Concrete: 40 MPa

Step s500: Aircraft/Tower/Target Impact Analysis. Using the tower model design presented above one then performs a tower impact dynamic analysis on all aircraft for all glide paths (within a predetermined level of required accuracy), given the above tower design. In this scenario two extreme aircraft are considered in the analysis, however, in actuality all the structurally different aircraft would be considered.

Consider the possible impact scenarios for the B-767. Given a random aircraft position with respect to the towers at impact, there is (scenario 1) a 93% probability of impacting one wing (see FIG. 11 illustrating the separation of one wing 210 from aircraft 200), and (scenario 2) a 7% probably of two wings striking (see FIG. 12 illustrating the separation of two wings 210 from aircraft 200).

With preliminary information on the structure of the wing-box, the aforementioned tower (5×10e6 lbs failure) imparts enough force to the wing at any impact point resulting in shear failure and separation of 80% of the impacting lifting surface.

If one considers the resulting aircraft trajectories after impacting the towers, calculations based on forces of impact, aerodynamic modification to aircraft due to loss of airfoil and partial analysis of dynamic aerodynamic drag factors, one can compare the outcome of no tower intervention, versus the scenarios presented.

In the following calculations, we assume that the towers spaced 160 apart, 1000 ft from the target with tower strength of 5×10e6 lbs and the maximum impact that the target (nuclear plant protection) is able to withstand is one by a 300,000 lb aircraft travelling at 340 mph (500 ft/s).

Analysis of B-767ER

Scenario: No Tower Impact

Mass—400,000 lbs, Speed at impact—700 ft/s

Result—breach of reactor vessel.

Scenario 1: Shearing of 80% of 1 Airfoil.

Remaining Mass—260,000 lbs, Speed at impact 400 ft/s

Time until reactor impact at tower collision—2 seconds.

Trajectory modification: Lateral Deflection—9 ft; Vertical Deflection—15 ft

Impact position modification: Roll position—70 degrees

Result: Shearing off the wing reduces the mass of the primary projectile and the impact velocity to values that are within the tolerance of the reactor building specifications. The position of the aircraft at impact is such that it is no longer in a missile like orientation, but rather as a bluff body with the new center of mass positioned lateral to the target. The fuselage is positioned 9 ft lateral to the target center and 15 ft lower than the intended target. In all cases of one wing shear, the target is protected.

Scenario 2: Shearing of 80% of Both Airfoils.

Remaining Mass—130,000 lbs, Speed at impact 400 ft/s

Time until reactor impact at tower collision—2 seconds.

Trajectory modification: Lateral Deflection—0 ft; Vertical Deflection—20 ft

Impact position modification: Roll position—0 degrees

Result: Shearing off the wings reduces the mass of the primary projectile and the impact velocity to values that are within the tolerance of the reactor building specifications. In all cases of two wing shear, the facility would be protected.

In summary, in all collision scenarios the B767 would be damaged to an extent that the primary projectile does not have enough energy to critically damage the reactor vessel or the reactor building.

Analysis of B-747 ER: Consider the possible impact scenarios for the B-747. Given a random aircraft position with respect to the towers at impact, there is a 68% probability of impacting one wing (scenario 1), and 32% probably of two wings striking (scenario 2).

Scenario: No Tower Impact

Mass—850,000 lbs, Speed at impact—720 ft/s

Result—breach of reactor vessel.

Scenario 1: Shearing of 80% of 1 Airfoil.

Remaining Mass—560,000 lbs, Speed at impact 500 ft/s

Time until reactor impact at tower collision—1.5 seconds.

Trajectory modification: Lateral Deflection—4 ft; Vertical Deflection—10 ft

Impact position modification: Roll position—50 degrees

Result: Shearing off the wing reduces the mass of the primary projectile and the impact velocity substantially; however this projectile still possesses more than the critical amount of energy required to destroy the target. The position of the aircraft at impact is such that it is no longer in a missile like orientation, but rather as a bluff body with the new center of mass positioned lateral to the target. The fuselage is positioned 4 ft lateral to the target center and 10 ft lower than the intended target. This means the projectile is still inline with the reactor vessel. The wing is positioned in an upward orientation, and therefore does not impact inline of the reactor vessel; however there is still the potential that the primary projectile might penetrate the target.

Scenario 2: Shearing of 80% of Both Airfoils.

Mass—283,000 lbs, Speed at impact 500 ft/s

Time until reactor impact at tower collision—1.5 seconds.

Trajectory modification: Lateral Deflection—0 ft; Vertical Deflection—24 ft

Impact position modification: Roll position—0 degrees

The result is that shearing off the wings reduces the mass of the primary projectile and the impact velocity to values that are within the tolerance of the reactor building specifications. In all cases of two wing shear, the facility is protected.

In summary, the reactor is not protected for the requisite impact scenarios. The reactor is only protected for 32% of the impact scenarios (two wings removed). Therefore a redesign of tower system is required.

Step s400: Tower Design. In order to shift the failure mode of the aircraft impact with the towers in the case of the B747, the spacing of the towers must be reduced to ensure both wings are separated from the aircraft in all situations. If the spacing of the towers were 112 ft, then it is ensured that both wings will always contact a tower. Given this spacing, the total number of towers required is 31. The towers will be 360 ft and designed to the same strength requirements as before.

Step s500: Aircraft/Tower/Target Impact Analysis. Analysis for B767. The impact and trajectory analysis for the B767 is the same as before, except that the probability of both wings shearing is increased to 47%. As before, the target is protected for all B767 impact scenarios.

Analysis for B747.Given a random aircraft position with respect to the towers at impact, the probability of both wings shearing is 100%. Therefore with the current tower design, leading to the impact scenario outlined previously (both wing separation) will protect the target in all scenarios.

In summary, in all collision scenarios (all glide paths, all aircraft) the aircraft is damaged to an extent that the primary projectile does not have enough energy to critically damage the reactor vessel. The projectile may hit the containment building inline with the reactor vessel, but the projectile does not have the energy to destroy the vessel. If it is deemed appropriate and another level of safety acquired, the towers can be placed further from the target. This scenario is expanded upon below.

Step s400: Tower Design. In order to reduce the cost of the tower construction, certain modifications in the design can be made that will not limit their functionality. For instance, in order to limit the amount of steel required in the construction, a higher yield strength can be used and therefore a thinner steel tube can be used. The size of the base of the tower can further be reduced and the extent of the foundation minimized through the use of a set of guy wires connecting the towers to the ground and the towers to each other.

Step s400: Tower Design, increased protection required. The impact point with the wing and the towers can be moved further from the target as required. This scenario is shown in FIG. 11. Here the towers are taller (546 ft) and more are required (47 towers) to cover a larger perimeter maintaining the same spacing between them. In this situation, the main body would strike the ground well short of the intended target. Over this time the projectile experiences more of a trajectory modification, the velocity of the projectile is reduced due to increasing drag penalties and the projectile is in more of a bluff orientation, effectively dissipating more energy over a larger area. It must be noted that each of these towers must withstand a large bending moment upon impact, therefore the strength requirements of the tower must be increased as shown below (note higher grade steel used, as well as 60% improvement in bending strength due to rebar). Given the bending moment, one can solve for required steel thickness:

L, tower height: 546 feet (167 m)

$F_{critical}$: Maximum bending force applied assumed to be 5.0 10E+6 lbs $D_b$, Tower base diameter: 27.4 feet, 8.4 meters.

$D_t$, Tower top diameter: 13.12 feet (4 meters).

Steel tube thickness at base: 3.0 inch

Outer steel tubing: High strength steel, Yield strength: 550 MPa.

Concrete Innerfill: Standard High Strength Concrete: 40 MPa

Additional re-enforced steel bars added to cement

Step s500: Analysis of Tower Design. Analysis of B-767ER

Scenario: No Tower Impact

Mass—400,000 lbs, Speed at impact—700 ft/s

Result—breach of reactor vessel.

Scenario 1: Shearing of 80% of 1 Airfoil.

Remaining Mass—260,000 lbs, Speed at impact 350 ft/s

Time until reactor impact at tower collision—3 seconds.

Trajectory modification: Lateral Deflection—38 ft; Vertical Deflection—50 ft

Impact position modification: Roll position—200 degrees

The result is that shearing off the wing reduces the mass of the primary projectile and the impact velocity to values that are within the tolerance of the reactor building specifications. The position of the aircraft at impact is be such that it is no longer be in a missile like orientation, but rather as a bluff body with the new center of mass positioned lateral to the target. The fuselage is positioned 38 ft lateral to the target center and 50 ft lower than the intended target. With most trajectories, the aircraft will miss the line of the target completely and will contact the ground well in front of the containment building.

Scenario 2: Shearing of 80% of Both Airfoils.

Remaining Mass—130,000 lbs, Speed at impact 350 ft/s

Time until reactor impact at tower collision—3 seconds.

Trajectory modification: Lateral Deflection—0 ft; Vertical Deflection—60 ft

Impact position modification: Roll position—0 degrees

The result is that shearing off the wings reduces the mass of the primary projectile and the impact velocity to values that are within the tolerance of the reactor building specifications. The fuselage impacts 50 ft lower than the intended target. With most trajectories the aircraft will contact the ground well in front of the containment building. In all cases of two wing shear, the facility is protected.

Analysis of B-747 ER

Scenario: No Tower Impact

Mass—850,000 lbs, Speed at impact—720 ft/s

Result—breach of reactor vessel.

Scenario 2: Shearing of 80% of Both Airfoils.

Remaining Mass—283,000 lbs, Speed at impact 470 ft/s

Time until reactor impact at tower collision—2.5 seconds.

Trajectory modification: Lateral Deflection—0 ft; Vertical Deflection—70 ft

Impact position modification: Roll position—0 degrees

The result is that shearing off the wings reduces the mass of the primary projectile and the impact velocity to values that are within the tolerance of the reactor building specifications. For most trajectories the primary projectile will contact the ground before hitting the target. In all cases of two wing shear, the facility is protected.

The above-described embodiment(s) of the present invention are intended to be examples only. Alterations, modifications and variations may be effected to the particular embodiments by those of skill in the art without departing from the scope of the invention, which is defined solely by the claims appended hereto.

What is claimed is:

1. A defense barrier for protecting a target from critical damage from the impact of an aircraft having a wingspan larger than a predefined minimum wingspan and a vertical approach angle less than a predefined maximum vertical approach angle, θ by imparting damage to the leading edge of a wing of the aircraft, the defense barrier comprising:

a plurality of towers at least partially surrounding the target to form the defense barrier, each of the plurality of towers having a height of at least about 360 feet above ground level and being spaced from a neighboring tower by a distance no greater than about 160 feet center to center, each of the plurality of towers being spaced from the target no greater than a distance of about 1000 feet, having a maximum strength requirement of at least about 5 10E6 lbs and being formed of a compressed concrete filled outer steel wall.

2. The defense barrier of claim 1, wherein each tower includes at least one protruding structure for opening a wing of the aircraft upon impact.

3. The defense barrier of claim 2, wherein each tower includes a fuel ignition mechanism.

4. The defense barrier of claim 3, wherein the fuel ignition mechanism is an electrical wire carrying an electrical current.

5. The defense barrier of claim 3, wherein the fuel ignition mechanism is a paint to enhance sparking.

6. The defense barrier of claim 1, wherein at least one of the plurality of towers is reinforced by cables fixed to the ground.

7. The defense barrier of claim 1, wherein at least one of the plurality of towers is reinforced by cables attached to at least one neighboring tower.

8. The defense barrier of claim 1, further including at least one tower with a height $h_1$ greater than 360 feet, and spaced from the target no greater than a distance of $$d = \frac{h_1}{\tan\theta} \text{ feet.}$$

9. A defense barrier surrounding a vulnerable target for imparting damage to the leading edge of an airplane wing before the airplane reaches the vulnerable target, the barrier comprising:

an array of towers, each tower in the array spaced from the target by a distance no greater than about 1000 feet, spaced from the nearest neighboring tower in the array by a distance of about 160 feet center to center, being about 360 feet tall, being formed of a compressed concrete filled outer steel wall, each tower being tapered from a base diameter of about 24 feet to a top diameter of about 13 feet, and having a ratio of steel to concrete between about 40:1 and about 120:1.

* * * * *